United States Patent [19]

Rousseau, deceased et al.

[11] Patent Number: 4,581,784

[45] Date of Patent: Apr. 15, 1986

[54] RAMP APPARATUS

[76] Inventors: Lucien H. M. Rousseau, deceased, late of Scituate, Mass.; by Lillian E. Rousseau, executrix, 228 Beaver Dam Rd., Scituate, Mass. 02110

[21] Appl. No.: 607,580

[22] Filed: May 7, 1984

[51] Int. Cl.[4] ..... E01D 1/00

[52] U.S. Cl. ..... 14/71.1; 114/263; 405/219; 405/220

[58] Field of Search ..... 14/69.5, 71.1, 72.5, 14/27; 405/219-221; 114/230, 258, 263, 362

[56] References Cited

U.S. PATENT DOCUMENTS

| | | | |
|---|---|---|---|
| 298,212 | 5/1884 | Knight | 14/72.5 X |
| 2,715,314 | 8/1955 | Smith | 405/219 |
| 3,511,393 | 5/1970 | Abromavage et al. | 14/71.1 X |
| 4,035,861 | 7/1977 | Edge | 14/72.5 X |
| 4,083,072 | 4/1978 | Ryan | 14/69.5 |
| 4,088,235 | 5/1978 | Thacker | 14/71.1 X |
| 4,133,067 | 1/1979 | Bennett et al. | 405/220 X |
| 4,242,032 | 12/1980 | Whiteman et al. | 14/71.1 X |

FOREIGN PATENT DOCUMENTS

| | | | |
|---|---|---|---|
| 2833357 | 2/1980 | Fed. Rep. of Germany | 14/69.5 |
| 2043567 | 10/1980 | United Kingdom | 14/69.5 |

*Primary Examiner*—Stephen J. Novosad
*Assistant Examiner*—John F. Letchford
*Attorney, Agent, or Firm*—Wolf, Greenfield & Sacks

[57] ABSTRACT

A ramp apparatus which provides access from a pier to a moored floating dock. The ramp is attached at its upper end by means of a double gimbel joint so as to permit the lateral and vertical motion of the dock and ramp. The lower end of the ramp is provided with wheels for permitting limited motion of the ramp over the dock surface. Also disclosed is a means for providing additional stability for the ramp particularly for wider ramps.

10 Claims, 7 Drawing Figures

Fig. 1
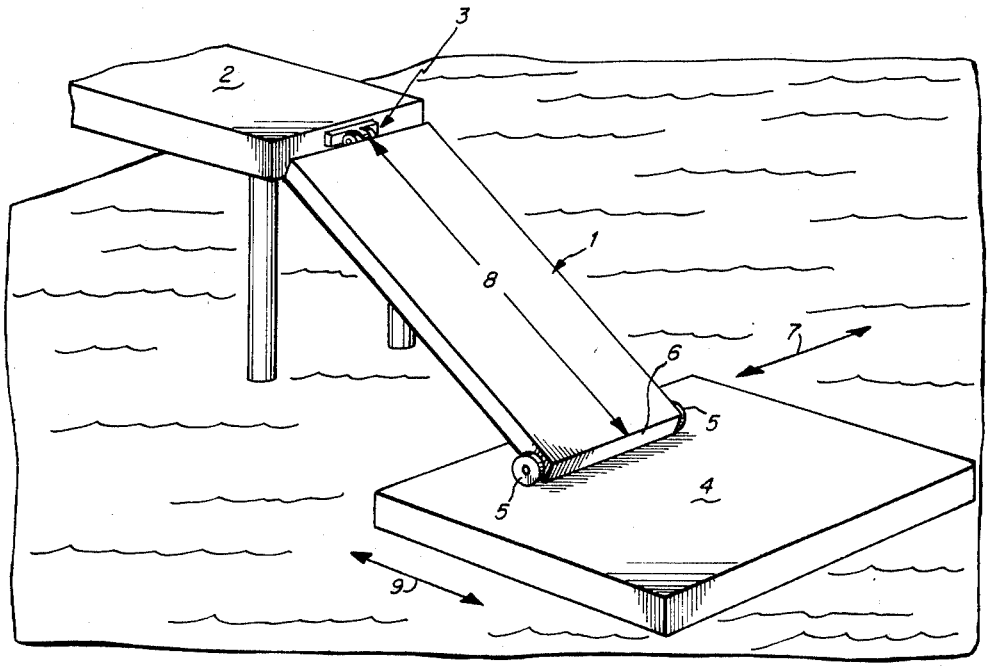
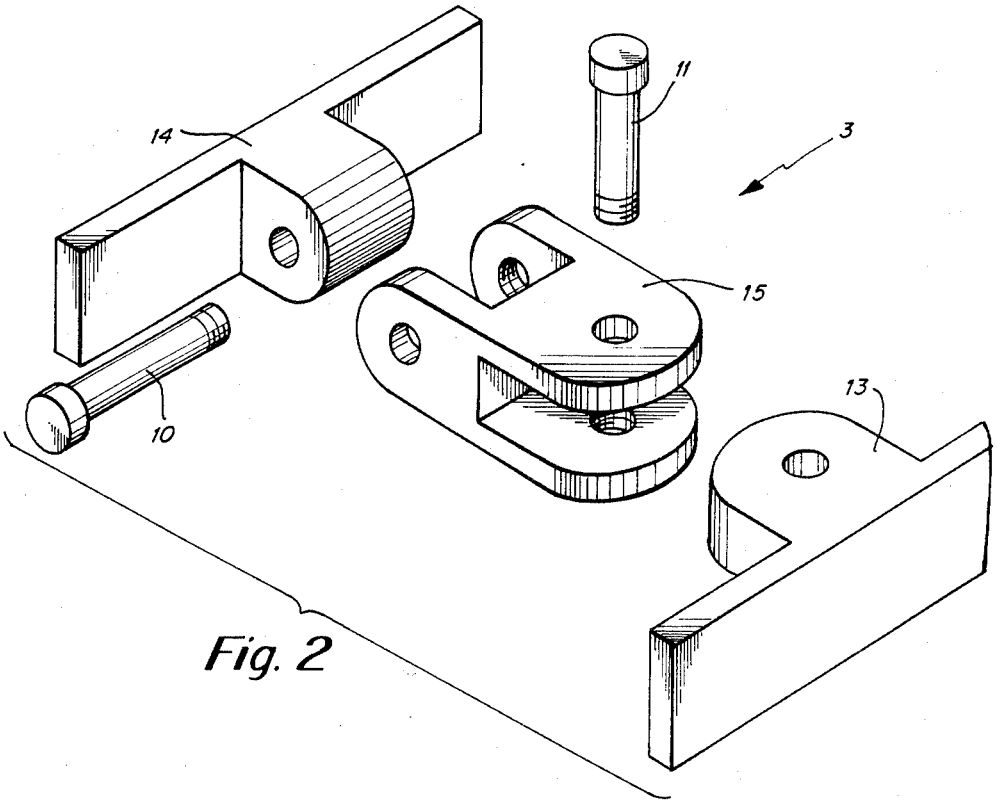
Fig. 2

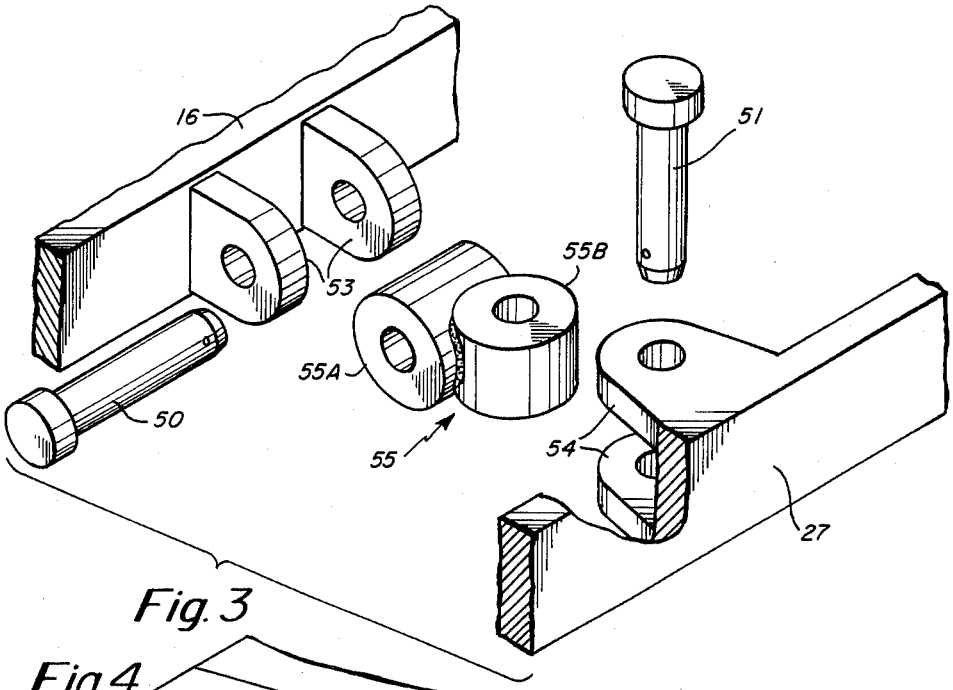
Fig. 3
Fig. 4
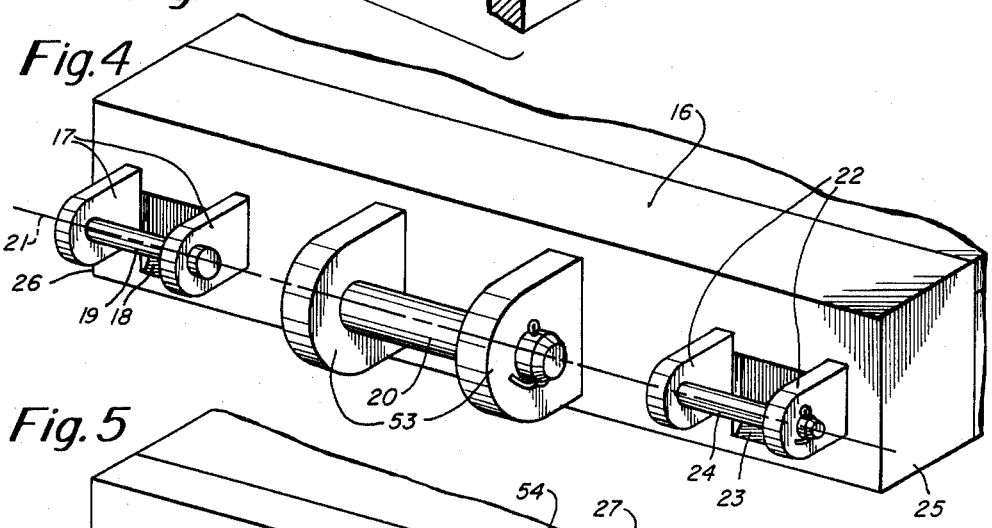
Fig. 5
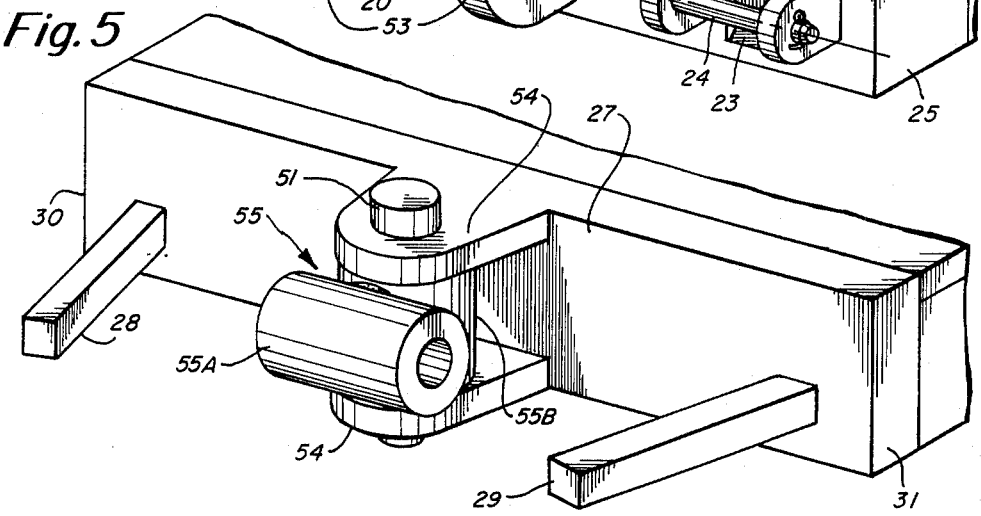

RAMP APPARATUS

BACKGROUND OF THE INVENTION

The present invention relates in general to a ramp apparatus and pertains, more particularly, to a ramp which provides access from a pier which is substantially fixed in position to a moored floating dock which may be subject to some limited motion either sideways or up and down.

Existing constructions generally employ a hinge to attach the ramp to the pier, the attachment being made so that the hinge pin is horizontal. This allows the dock-end of the ramp to rise and fall as the dock rises and falls. However, with such an arrangement, there is damage to the pier, ramp, and/or dock when the dock moves in a direction perpendicular to the long dimension of the ramp (side-to-side).

One existing construction relating to a floating wharf or mooring is described in the patent to Smith U.S. Pat. No. 2,715,314. This shows the use of hinging both at the pier end and at the dock end of the apparatus. In the Smith patent, they intend to provide a floating dock which is restricted from moving laterally. Thus, when the dock tends to move, there is substantial stress conveyed back to the pier by way of the interconnecting structure shown in the Smith patent. It is also noted in the Smith patent that the construction is relatively complex requiring a number of hinging members.

Accordingly, it is an object of the present invention to provide a ramp which provides access from a pier to a moored floating dock and in which the dock-end of the ramp is allowed to follow the lateral motion of the dock thus eliminating lateral-motion damage.

Another object of the present invention is to provide the lateral motion as in accordance with the preceding object and to accomplish this without any loss of ramp stability.

Still a further object of the present invention is to provide an improved ramp construction for interconnecting between a pier and floating dock and which is relatively simple in construction, can be fabricated relatively inexpensively and requires little if any maintenance.

A further object of the present invention is to provide an improved ramp construction for interconnecting between a pier and a floating dock which provides enhanced ramp stability particularly for wider ramps.

SUMMARY OF THE INVENTION

To accomplish the foregoing and other objects, features and advantages of the invention, there is provided a ramp apparatus which is adapted to provide access from a pier to a moored dock. The pier may be considered as substantially fixed in position, but the moored dock tends to float, particularly in a side-to-side direction and also tends to rise and fall as the water level rises and falls. The pier end of the ramp is attached to the pier by a universal or double gimbel connection while the dock-end of the ramp is provided with wheels which allow movement along the surface of the dock in a direction parallel to the long dimension of the ramp. The universal connection permits the dock end of the ramp to shift from side-to-side as the dock shifts side-to-side in a direction perpendicular to the long dimension of the ramp. In an alternate embodiment of the present invention, there is also provided a ramp apparatus which has enhanced stability and which is particularly adapted for application with wider ramps.

BRIEF DESCRIPTION OF THE DRAWINGS

Numerous other objects, features and advantages of the invention should now become apparent upon a reading of the following detailed description taken in conjunction with the accompanying drawing, in which:

FIG. 1 is a perspective view illustrating the ramp apparatus of the present invention as it relates to the interconnection between a pier and floating dock or wharf;

FIG. 2 is a perspective view illustrating the double gimbel attachment of ramp-to-pier;

FIG. 3 is a perspective view illustrating an alternate arrangement for a double gimbel joint for attachment of ramp-to-pier;

FIG. 4 is a perspective view of an alternate embodiment of the invention illustrating the construction at the ramp;

FIG. 5 is also a perspective view associated with the view of FIG. 4 for the alternate embodiment;

DETAILED DESCRIPTION

Figure 6:
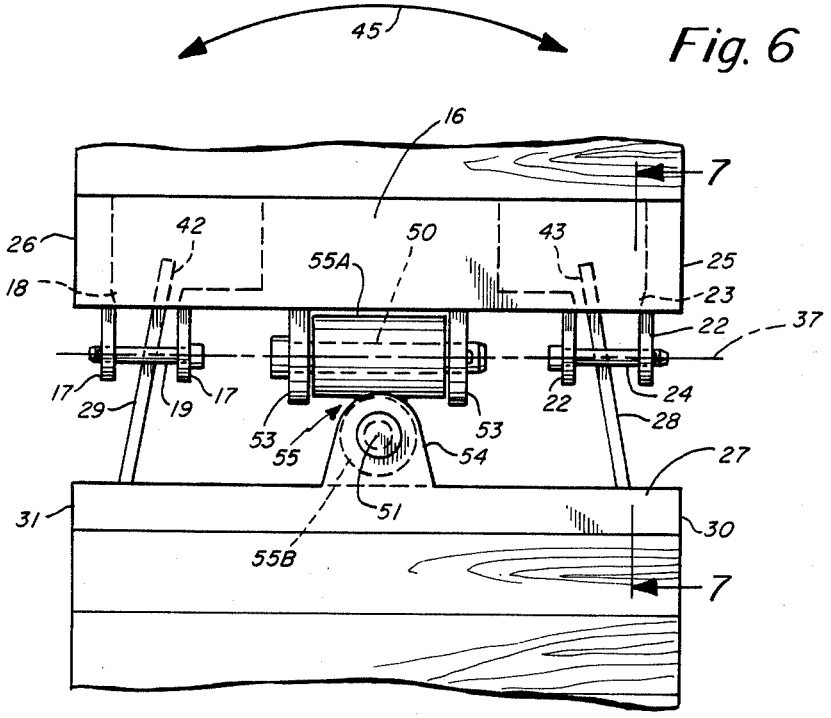
FIG. 6 is a top plan view showing the embodiment illustrated in FIGS. 4 and 5 connected together.

FIG. 1 illustrates the overall system which includes a ramp 1 adapted to interconnect between a pier 2 and dock 4. The ramp is connected to the pier by means of a universal or double gimbel joint 3 which is illustrated in more detail in FIG. 2. At the bottom end 6 of the ramp 1 there are provided a pair of wheels 5. The wheels 5 permit the ramp 1 to move along the surface of the dock 4.

It is assumed in FIG. 1 that the pier 2 is relatively fixed in position and it is further assumed that the dock 4 although relatively stationary may move either side-to-side as shown by the arrow 7 or forward and back as indicated by the arrow 9. Because the ramp 1 is not connected to the dock 4 at the ramp end 6, the dock 4 is free to move in the directions of arrow 9 and arrow 7 without imposing any stress or tension in the ramp 1 or pier 2.

The double gimbel joint 3 is illustrated in detail in FIG. 2. The joint includes a ramp side member 13 and a pier side member 14 which are interconnected by means of the joint 15. FIG. 2 also shows the pins 10 and 11. The ramp side member 13 and the pier side member 14 are each suitably secured to the respective pier and ramp such as by use of bolts or screws. These members may also be welded to the pier and ramp and are at least partially made of metal.

The double gimbel joint 3 permits the dock-end 6 of the ramp to shift from side-to-side and away from the pier as indicated by the arrows 9 which extends in the long dimension 8 of the ramp. The double gimbel joint also permits shifting as indicated by the arrow 7 in FIG. 1 which is in the perpendicular direction to the long dimension 8 of the ramp. The gimbel joint of course also permits simultaneous combinations of these motions. The double gimbel joint 3 is arranged as a double hinge with one pin 10 disposed horizontally and the other pin 11 disposed vertically. The action about the horizontal pin 10 allows the dock-end 6 of the ramp to rise and fall without creating any stress in the ramp or pier. The action about the vertical pin 11 allows the dock-end 6 of the ramp to move horizontally in a direction perpendicular to the long dimension 8 of the ramp.

Thus, in accordance with the present invention, there is provided for a ramp that provides access between a pier and a floating dock or wharf. This ramp is characterized by a combination of features that provide substantially improved results. These features include the use of wheels at the bottom of the ramp so as to permit easy motion of the ramp on top of the dock in a forward to back direction. This is combined with the use of a double gimbel arrangement which permits motion of the bottom end of the ramp up and down and also side-to-side.

FIGS. 3–7 illustrate an alternate embodiment of the present invention. In this version of the invention, the gimbel joint is quite similar to the one illustrated in FIG. 2. This joint is illustrated in a perspective view in FIG. 3. This embodiment of the invention also has enhanced stability particularly for use with wider ramps.

FIG. 3 illustrates the ramp side portion 16 having spaced ears 53 for receiving the joint 55. Actually, the ears 53 receive therebetween the joint end 55A. Similarly, there is illustrated in FIG. 3 a pier side portion 27 also having extending therefrom a pair of spaced ears 54 for receiving the orthogonally disposed end 55B of the joint 55. FIG. 3 also illustrates the pin 50 for securing the end 55A of the joint between the ears 53 and the pin 51 for securing the end 55B of the joint between the ears 54.

FIG. 4 illustrates the ramp side portion 16 of the stabilizer which is comprised of two support pins 19 and 24 disposed between two pairs of brackets 17 and 22. The pairs of brackets 17 and 22 are disposed on either side of rectangular slots 18 and 23 cut into the ramp side portion 16. It is preferred that one slot 18 be positioned near the left side 26 of the ramp side portion 16, and that the other slot 23 be placed near the right side 25 of the ramp side portion 16 so that the long sides of each slot 18 and 23 are horizontal as illustrated.

As also illustrated in FIG. 4 one pair of brackets 17 is affixed one bracket each to a vertical side of the slot 18. The other pair of brackets 22 are affixed in a like manner next to the vertical sides of the right side slot 23.

The support pins 19 and 24 are mounted as illustrated in FIG. 4. One pin 19 is mounted in the bracket pair 17 and the other pin 24 is mounted in the bracket pair 22. This mounting may be in a conventional manner and may include the use of a cotter pin or the like to secure the pins in place. The support pins 19 and 24 are mounted so that the centers thereof are co-linear with the center of the horizontal clevis pin 20. The clevis pin 20 illustrated in FIG. 4 may be the same as the pin 50 illustrated in FIG. 3. In FIG. 4 the broken line 21 illustrates the co-linear positioning of the support pins 19 and 24 with the horizontal clevis pin.

FIG. 5 illustrates the pier side portion 27 of the stabilizer which is comprised of a left support arm 28 and a right support arm 29 which extends outwardly from the pier side portion 27. These arms extend at a slight angle as illustrated in FIGS. 5 and 6. The left support arm 28 is affixed near the left edge 30 and inclined toward the right edge 31. The right support arm 29 is affixed near the right edge 31 and is inclined toward the left edge 30. The horizontal surfaces of the support arms 28 and 29 define a plane perpendicular to the surface of the pier side portion 27.

FIG. 5 also illustrates the joint 55 with its end 55B engaged between the ears 54 of the pier side portion 27.

FIG. 6 illustrates a plan view showing the ramp side portion 16 connected with the pier side portion 27. A broken line 37 illustrates the co-linear positioning of the support pins 19 and 24 with the horizontal clevis pin 50 (essentially the same as pin 20 illustrated in FIG. 4). The support arms 28 and 29 attached to the pier side portion 27 pass under the support pins 24 and 19 and through the rectangular slots 23 and 18, respectively. The extension of the portion of the support arms protruding into the ramp side portion 16 is illustrated by dotted outline at 42 and 43. There is sufficient lateral clearance between the sides of the rectangular slots 18 and 23 and the respective support arms 29 and 28 to permit the ramp to move laterally as depicted by the arc 45 which is concentric with the vertical clevis pin 51.

Figure 7:
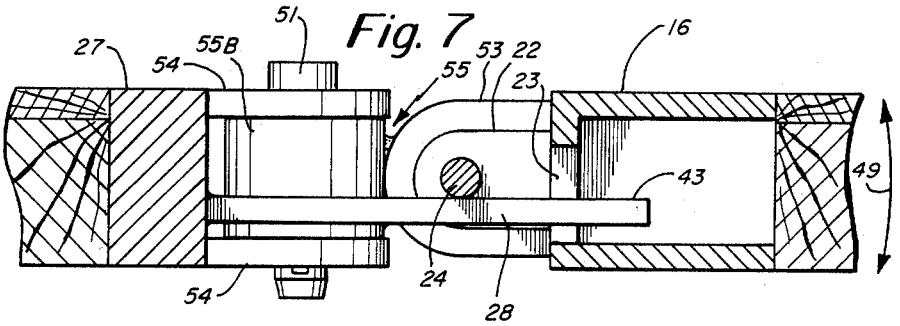
FIG. 7 is a cross sectional view taken along line 7—7 of FIG. 6.

FIG. 7 is a cross sectional view taken along line 7—7 of FIG. 6 showing further detail of the stability enhancement. FIG. 7 illustrates one of the support arms 28 extending under the support pin 24. FIG. 7 also illustrates the slot 23 into which the support arm 28 extends. It can be seen from FIG. 7 that the support arm 28 along with the position of the slot 23 and the support pin 24 are constructed and positioned so that the top of the support arm 28 contacts the bottom of the support pin 24. There is provided adequate clearance between the support arm 28 and the edges of the slot 23 so that the ramp side portion 16 can rise and fall vertically as depicted by the arc 49 which is concentric with the support pin 24.

Having described a limited number of embodiments of the present invention, it should now be apparent to those skilled in the art that numerous other embodiments and modifications thereof are contemplated as falling within the scope of the present invention.

What is claimed is:

1. A ramp apparatus for providing access between a pier and a moored floating dock and comprising, a ramp member having a pier end and a dock-end, double joint means at the end of the pier end of the ramp permitting the dock-end of the ramp to have both horizontal and vertical motion, and means at the dock end of the ramp including wheel means for permitting the dock end of the ramp to move over the dock top surface, means interconnecting between the ramp and pier for providing ramp stability while permitting limited horizontal and vertical ramp motion, said means for providing ramp stability including a pair of support members on one of said ramp and dock and extending into slots on the other of said ramp and dock.

2. A ramp apparatus as set forth in claim 1 wherein said wheel means comprise a pair of wheels one on either side of the ramp.

3. A ramp apparatus as set forth in claim 1 wherein the length of the ramp is greater than its width.

4. A ramp apparatus as set forth in claim 1 including spaced brackets next to said slots on the ramp for supporting therebetween a support pin against which the support member is urged.

5. A ramp apparatus as set forth in claim 4 wherein the support members are in the form of elongated extensions supported from the pier at opposite sides thereof and disposed converging toward each other.

6. A ramp apparatus as set forth in claim 5 wherein the elongated extensions are disposed under the support pins and are free to move in the slots to accommodate side-to-side and up and down motion of the ramp relative to the pier.

7. A ramp apparatus as set forth in claim 1 wherein said double joint comprises a ramp side member, a pier side member and a joint member interconnecting said ramp side member, and pier side member.

8. A ramp apparatus as set forth in claim 7 further comprising pin means including a horizontal pin and a vertical pin.

9. A ramp apparatus as set forth in claim 8 wherein said horizontal pin allows the dock end of the ramp to rise and fall and wherein the vertical pin allows the dock end of the ramp to move horizontally in a direction perpendicular to the long dimension of the ramp.

10. A ramp apparatus for providing access between a pier and a moored floating dock and comprising, a ramp member having a pier end and a dock-end, double joint means at the end of the pier end of the ramp permitting the dock-end of the ramp to have both horizontal and vertical motion, and means at the dock end of the ramp including wheel means for permitting the dock end of the ramp to move over the dock top surface, means interconnecting between the ramp and pier for providing ramp stability, said means interconnecting comprising a pair of support members on one of said ramp and dock and extending into slots on the other of said ramp and dock.

* * * * *